United States Patent [19]

Roberts et al.

[11] Patent Number: 4,566,142

[45] Date of Patent: Jan. 28, 1986

[54] SEAT SHOWER

[75] Inventors: Timothy J. Roberts; Thomas J. Roberts, Jr.; Thomas J. Roberts, Sr., all of Wood Dale; Robert P. Marinier, Jr., Glendale Heights, all of Ill.

[73] Assignee: Hospital Therapy Products, Inc., Wood Dale, Ill.

[21] Appl. No.: 501,131

[22] Filed: Jun. 6, 1983

[51] Int. Cl.[4] ..... A47K 3/22

[52] U.S. Cl. ..... 4/604; 4/596; 4/601; 4/DIG. 18; 403/362; 403/391

[58] Field of Search ..... 4/596–598, 4/601–605, 611, 615, 655, 580, 621, DIG. 18, 570, 589, 590; 128/65, 66, 369, 366; 403/362, 366, 391, 396, 400

[56] References Cited

U.S. PATENT DOCUMENTS

| | | | |
|---|---|---|---|
| 1,360,382 | 11/1920 | Edwards | 4/615 X |
| 1,572,275 | 2/1926 | Ewing | 4/590 X |
| 1,724,147 | 8/1929 | Russell | 4/615 X |
| 3,587,118 | 6/1971 | Compton | 4/604 |
| 3,884,258 | 5/1975 | Mull | 4/615 X |
| 3,938,200 | 2/1976 | Roberts et al. | 4/580 |
| 3,971,074 | 7/1976 | Yxfeldt | 4/612 |
| 3,971,080 | 7/1976 | Walker | 4/570 |
| 4,118,810 | 10/1978 | Brickhouse et al. | 4/590 X |
| 4,160,292 | 7/1979 | Kuether et al. | 4/615 |

FOREIGN PATENT DOCUMENTS

| | | | |
|---|---|---|---|
| 1556486 | 11/1979 | United Kingdom | 403/362 |

*Primary Examiner*—Charles E. Phillips
*Attorney, Agent, or Firm*—Welsh & Katz, Ltd.

[57] ABSTRACT

An improved seat shower for facilitating the care and treatment of patients in a clean shower environment, including a framework of such a height as to permit 360° access to the seated patient, and a plurality of adjustable shower nozzles positioned about the seating area. Clean, disposable plastic liners are draped over the framework and base to maintain aseptic conditions.

8 Claims, 8 Drawing Figures

FIG. 4
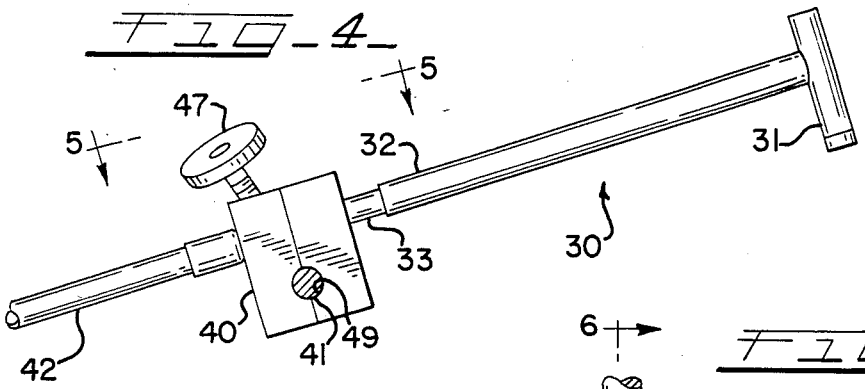
FIG. 5
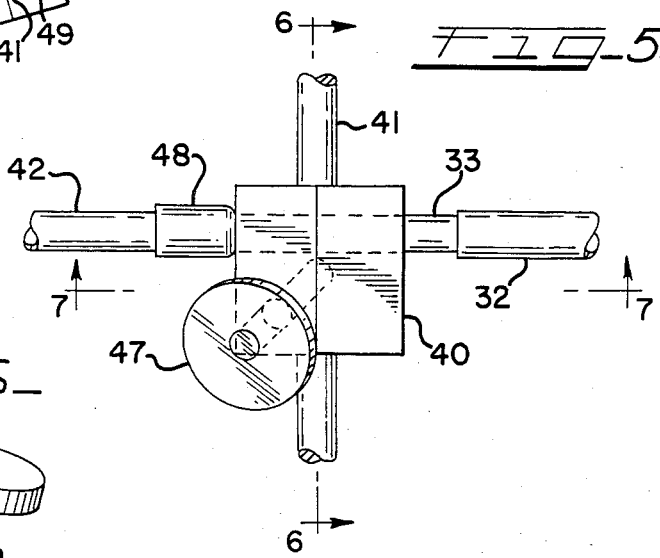
FIG. 6
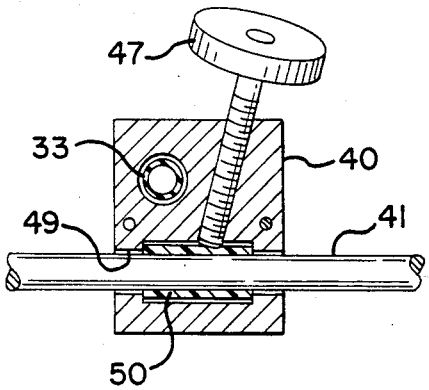
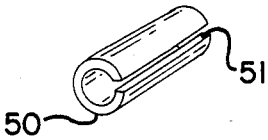
FIG. 8
FIG. 7
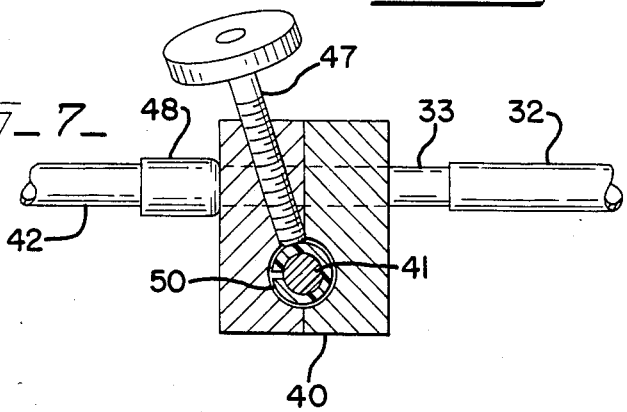

SEAT SHOWER

This invention relates to apparatus facilitating the care of infection prone patients. More particularly, this invention relates to an improved sitdown shower which provides for increased access to a patient and plurality of completely adjustable shower heads.

The care of patients having open wounds or otherwise highly susceptible or vulnerable to infection causing bacteria such as burn patients, requires a washing or showering procedure in which the bath area, commonly a shower or hydrotherapy tub, is thoroughly cleaned and sterilized each time so that cross infection of the patients will not occur.

Until the advent of biologically clean plastic films for lining a bath to establish a physical barrier between the bath and the patient, as taught in U.S. Pat. Nos. 4,106,133 and 3,938,200, the bath surface would have to be physically scrubbed and meticulously disinfected between each use, an hours-long procedure. However, even with the clean plastic films, certain remaining problems have been noted in the treatment of certain types of patients. For instance, when treating burn patients, dead skin must be removed without disturbing the remaining live skin with a minimum of discomfort to the patient. In such areas, present techniques leave much to be desired, both in patient comfort and facility of treatment. Also, when showering unstable patients in the seated position, observation and/or treatment of such patients without movement of the patient himself is highly desirable.

Therefore, an object of the subject invention is a sitdown shower which provides secure seating and allows observation and treatment of patients with 360° access to the patient at all times.

A further object of the subject invention is a new and improved sitdown shower with which to bathe and treat patients.

Still another object of the subject invention is a shower unit having shower nozzles which are completely adjustable as to pressure and temperature of the water as well as being adjustable in position about the patient and angle of spray against the patient.

These and other objects are obtained in accordance with the present invention wherein there is provided an improved sitdown shower having secure and clean seating for unstable patients. Biologically clean disposable liners are used to line or cover the structural framework and the seat of the invention. A plurality of shower nozzles are disposed about the seated area. These shower nozzles each comprise an adjustable orifice supported in cantilever fashion by a stainless steel conduit attached to a support block secured in sliding engagement with a support rod. The support rod generally extends about the circumference of the bath framework in straight line fashion, thereby allowing the nozzles to be positioned about the bath as desired. Each nozzle may rotate in limited fashion about the support rod while the spray nozzle itself may rotate about the axis of the cantilever support rod. Thus the water spray may be effectively adjusted to deliver water from any desired location about the shower and at any desired angle. The overall height of the shower is approximately waist high on all four sides thereby allowing treatment personnel such as doctors or nurses complete access to the patient to allow for cleansing or other treatment procedures, without requiring movement of the patient.

DESCRIPTION OF THE DRAWINGS

Further objects of the invention together with additional features contributing thereto and advantages accruing therefrom will be apparent from the following description of one embodiment of the invention when read in conjunction with the accompanying drawings wherein:

FIG. 4 is a side view showing one embodiment of a shower nozzle assembly according to the subject invention.

FIG. 5 is a top view taken from the line 5—5 of FIG. 4 showing the shower nozzle support block assembly of FIG. 4.

FIG. 6 is a cross-section taken on line 6—6 of FIG. 5 showing the means for securing the shower nozzle assembly in one position about the patient.

FIG. 7 is a cross-section taken along line 7—7 of FIG. 5 showing the means for tightening the shower nozzle assembly in one position about the patient.

FIG. 8 is a perspective view of the phenolic sleeve for engagement with the shown nozzle assembly support rod.

Referring now to FIG. 1, there is shown the improved sitdown shower 10 of the subject invention, having a plurality of shower nozzle assemblies 30 surrounding a seat 13 of the sitdown shower. The shower itself has a structural framework 12 which may comprise tubular stainless steel or other easily cleanable material. The tubular framework 12 is supported by a base portion 14 which may be of fiber glass or similarly easily formable material. Framework 12 has a maximum height in the rear portion of approximately three to four feet, or about waist high for most people. At this height, full access to the potion of his body without corresponding movement of the patient. Treatment personnel may easily reach in over the framework 12 and perform treatment on the patient without danger of becoming overly wet, without assuming any precarious positions and otherwise remaining in complete control of the patient without harm or problems, while maintaining an aseptically clean environment.

Figure 1:
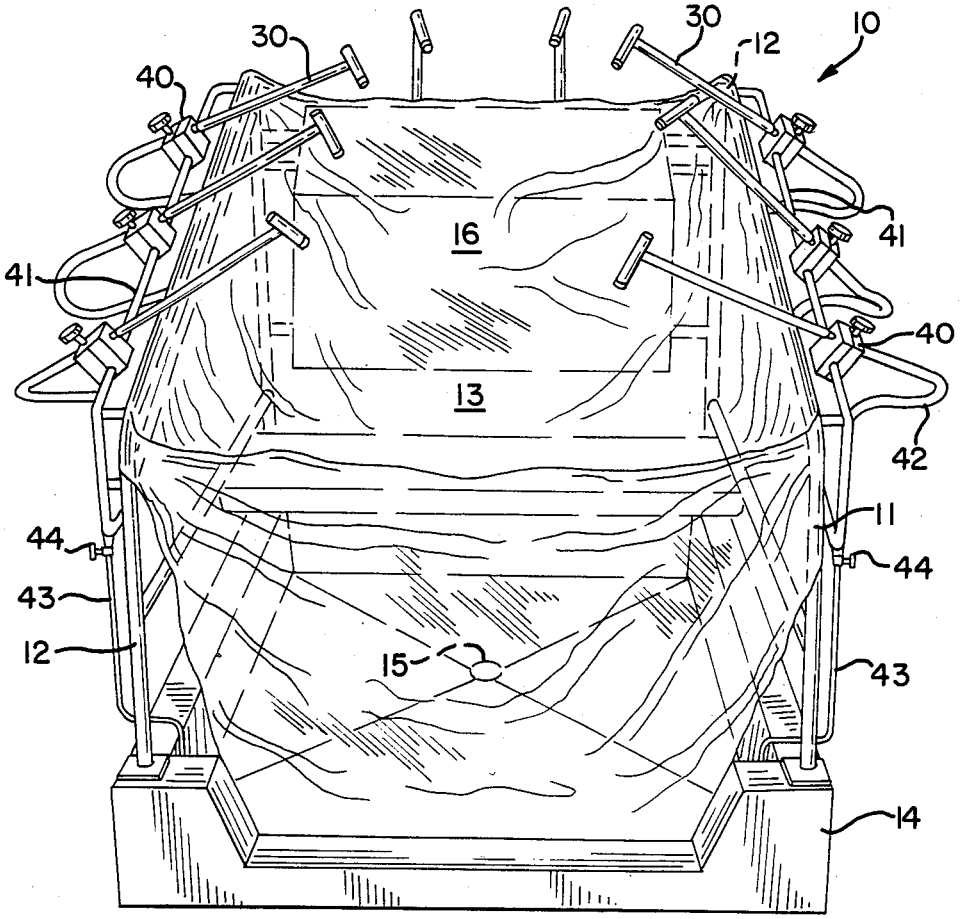
FIG. 1 is a perspective view of one embodiment of the subject invention.
Figure 2:
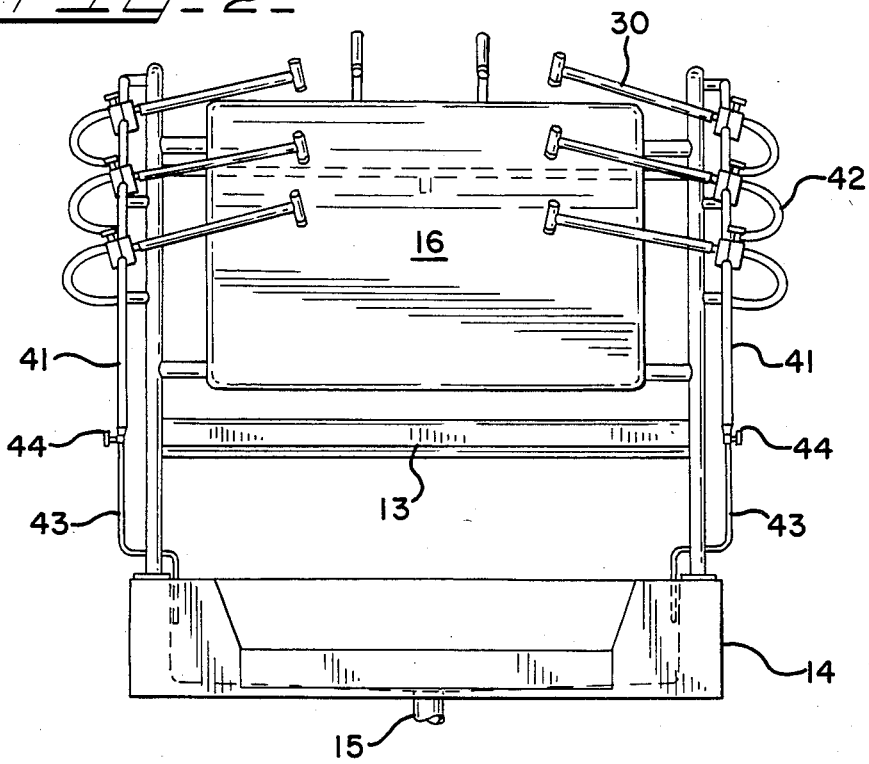
FIG. 2 is a front view of the improved sitdown shower shown in FIG. 1.

The base portion 14 has elevated side panels to contain and direct the water to a drain 15. The rear portion of the sitdown shower of the subject invention comprises a backrest or support 16 for substantial and comfortable back support for the seated patient. As stated, the shower nozzle assemblies 30 are positioned about the seated shower area of the subject invention. Each shower nozzle assembly is secured to a nozzle support bar 41. The support bar 41 generally surrounds the framework structure 12 of the shower bath and may comprise a continuous length of conduit or rod or may be discontinuous, in such discrete lengths as desired. As better shown in FIGS. 2 and 3, the nozzle assembly support rod 41 in one embodiment of the subject invention is discontinuous, being in three segments. A segment of the support rod 41 is along each side of the sides, with one segment along the rear portion of the bath. Support rod 41 is generally circular in cross-section for reasons which will become apparent.

Figure 3:
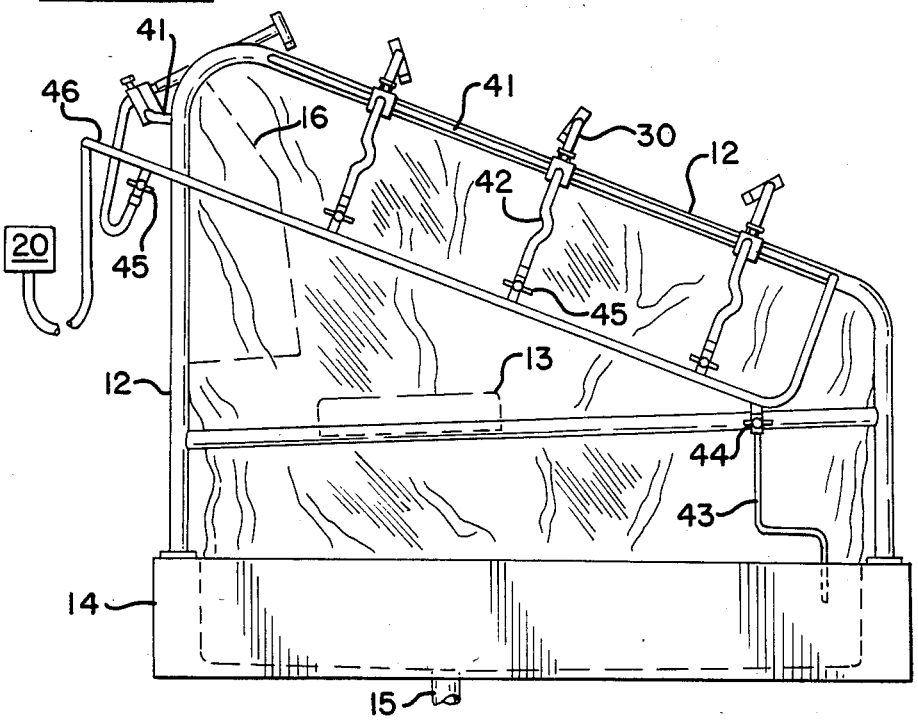
FIG. 3 is a side view of the improved sitdown shower shown in FIG. 1.

In general, water is supplied to the shower apparatus 10 of the subject invention from a control device 20 through lines 46, best shown in FIG. 3. The control device 20 shown in FIG. 3 may provide a means of controlling or regulating the pressure and temperature of the water to that desired. A suitable control means may be found disclosed in concurrently filed application Ser. No. 501,132 assigned to the assignee of the subject invention.

In general, water regulated to the temperature, pressure and volume desired is fed from incoming conduit 46 to the shower nozzle assemblies 30 through intermediate flexible hose 42. The pressure to each individual shower nozzle assembly 30 may be controlled through valve 45 located on the infeed line 46 of each shower nozzle assembly 30 of the subject invention. Once pressure to the entire system is shut off, the system may be drained through valve 44 and drain line 43, connected to each bank of shower nozzle assemblies. As stated, each individual shower nozzle assembly, shown in FIGS. 4–7, is rotatable in a plane perpendicular to the axis of these support rods 41 as well as the shower nozzle itself being rotatable coaxially with the cantilever support rod 32. Such extensive range of motion is accomplished in the following manner: Support block 40 comprises two block halves fastened together as with screws or like means to form a cylindrical passageway 49 through which support rod 41 passes. Within passageway 49 is sleeve 50, shown in FIG. 8. Sleeve 50 is hollow, cylindrical in shape and formed of a thermoset phenolic, having an inside diameter closely approximately the diameter of the support rod 41. Preferably the phenolic must have high tensile, compressive, flexural and impact strengths. Good machinability of the material is also preferred as this leads to an inexpensive manner of forming the sleeve. A preferred phenolic cylinder which can be cut and machined into the appropriate shape is formed of "Garolite" phenolic. The most preferred material for forming the sleeve is "Garolite Grade C" phenolic. This material is made by applying heat and pressure to layers of canvas impregnated with the thermoset phenolic.

As shown in FIG. 8, sleeve 50 is, in cross-section, in the shape of a "C", having a longitudinal slit 51 down its walls. Slit 51 is exaggerated in size to better show it and its function. By virtue of the slit 51 in sleeve 50, the sleeve 50 may be compressed to engage and tightly secure itself to support rod 41. Compression of the sleeve may be supplied by set screw 47 or other like compression means. Set screw 47 is secured within support block 40 in a threaded manner so that upon rotation, the set screw 47 moves vertically within block 40 for engagement and disengagement with phenolic sleeve 50. Upon engagement of the set screw 47 with the phenolic sleeve 50 and tightening, the phenolic sleeve tightly and securely grips the support rod 41, thereby allowing for the stationary positioning of the shower nozzle assembly 30 where desired about the seating area. Because the sleeve 50 is of the phenolic substance above described, it will tightly grip support 41 and yet instantaneously release its grip on the support rod 41 when tension or compression is released by unscrewing the set screw 47 to thereby move the set screw 47 outwardly from contact with sleeve 50. Such a tight grip and yet instantaneous release is a highly desirable feature, allowing for quick, easy and accurate positioning of the spray nozzle, without sticking or slipping.

The spray nozzle 31 of the nozzle assembly 30 is fixedly secured to one end of the cantilever support rod 32 and delivers fluid, such as water, in a spray which may be adjustable in intensity and spray pattern. Cantilever support rod 32 is attached to fitting conduit 33 in coaxial manner and permitted freedom of movement in a rotational mode about the common axis of cantilever support rod 32 and conduit fitting 33. The cantilever support rod 32 may be attached to the conduit fitting 33 through an internal snap ring assembly in combination with an O-ring. Thus the spray nozzle is free to rotate about the common axis in a fluid-tight manner and yet may not be easily removed from its attachment to the conduit fitting 33. Any other means for securing the spray nozzle to the feed line while retaining a capability of leakproof rotation about the cantilever support rod axis may be used as known in the art.

The shower bath of the subject invention provides therefore for a safe and secure place for an unstable patient to sit while a doctor, nurse or other technician treats the patient. When a burn patient is under treatment, for instance, dead skin must be removed from the body of the patient. In a procedure which normally is capable of providing excruciating pain for the patient, the subject invention allows for a lessening of the discomfort experienced while permitting an ease of access for the treatment personnel and therefore quickening the pace for the treatment itself.

The individual positioning capability of each shower nozzle permits adjustment of the spray of the water to the area desired to provide either equal spray over the entire patient or localized spray on one section of the patient's body. The low profile of the shower bath of the subject invention provides that the treatment may be performed with the minimum of discomfort to doctors and nurses and therefore much greater efficiency and effectiveness.

When the shower bath of the subject invention is used in conjunction with a biologically clean or aseptic disposable liner, a treatment facility can easily and quickly set up the bath in a biologically clean manner without extended cleansing procedures, perform the treatment in a quick and easy manner with minimal discomfort to the patient. The entire treatment can be repeated with a different patient within a relatively short time while maintaining the level of cleanliness to prevent crossinfection, thereby permitting more patients to be taken care of in less time and in a more efficient and effective manner.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A shower bath for use in the treatment of patients highly susceptible to infection causing bacteria comprising, in combination, a base adapted for support on a floor surface or the like, said base having relatively low-height side panels defining a shower flow area having a drain, an open-sided framework supported on said base and including laterally opposite side frames each of which has an upstanding front corner post, an upstanding rear corner post, and an upper hand rail connected at either end to the upper ends of the corresponding front and rear corner posts and being disposed at a height approximating the waist height of a human being so as to enable a person to enter the shower area while grasping said upper hand rails, liquid impermeable disposable liner means adapted to overlie said shower area and be removably supported by said framework so as to substantially enclose the periphery of said shower area to substantially waist height, an elongated support rod mounted on each of said side frames in generally parallel outwardly spaced relation from the corresponding upper hand rail so as to facilitate grasping of said hand rails without interference by said support rods, and a plurality of discrete shower nozzle assemblies mounted on each of said support rods, each shower nozzle assembly including support means selectively positionable along the length of the corresponding support rod, an elongated tubular nozzle rod supported by each support means so as to extend therefrom in cantilever fashion and being adapted for connection at one end to a fluid supply, each of said nozzle rods being rotatable and slidable about its own axis relative to its corresponding support means and rotatable together with its support means about the axis of the corresponding support rod while said nozzle rods are maintained in a plane substantially perpendicular to said support means, and a spray nozzle supported on the other end of each of said nozzle rods in fluid communication with the corresponding fluid supply so as to enable selective fluid discharge therefrom, said spray nozzles being selectively positionable to impinge fluid onto a patient disposed within said shower area from various angular directions.

2. A shower bath as defined in claim 1 wherein said upper hand rails are inclined upwardly and rearwardly from the corresponding front to the corresponding rear corner posts.

3. A shower bath as defined in claim 1 including seat means supported within said base so as to be generally horizontally disposed.

4. A shower bath as defined in claim 3 wherein said framework includes at least two generally parallel transverse frame members having their opposite ends affixed to said rear corner posts, and a back rest supported on said transverse frame members.

5. A shower bath as defined in claim 4 further including a substantially horizontal support rod supported by and between said rear corner posts, and at least one shower head assembly mounted on said horizontal support rod in a manner to enable selective positioning therealong, said last mentioned shower head assembly including a spray nozzle adapted for connection to a fluid supply.

6. A shower bath as defined in claim 1 including means enabling selective control of fluid pressure supplied to each of said nozzle assemblies.

7. The shower bath of claim 1 wherein said support means has an internal passageway, a sleeve within said passageway, said sleeve having a longitudinal slit allowing compression of said sleeve about the corresponding support rod to secure said shower nozzle assembly in a desired position.

8. The shower bath of claim 7 wherein said sleeve is formed of thermoset phenolic for better gripping capabilities.

* * * * *